US005489061A

United States Patent [19]

Fogle et al.

[11] Patent Number: 5,489,061

[45] Date of Patent: Feb. 6, 1996

[54] CARTON WITH MULTI-PLY FOLDS

[75] Inventors: James C. Fogle; John A. Ross, both of Marietta, Ga.

[73] Assignee: Riverwood International Corporation, Atlanta, Ga.

[21] Appl. No.: 343,739

[22] Filed: Nov. 22, 1994

[51] Int. Cl.[6] ..... B65D 5/32; B65D 5/42

[52] U.S. Cl. ..... 229/109; 220/416; 229/23 R; 229/919; 229/930; 493/151; 493/162

[58] Field of Search ..... 229/109, 110, 229/23 R, 169, 915, 919, 930, 931; 220/416, 418, 443; 493/128, 141, 151, 162

[56] References Cited

U.S. PATENT DOCUMENTS

| | | | |
|---|---|---|---|
| 1,959,193 | 5/1934 | Boeye | 220/418 |
| 1,973,930 | 9/1934 | Rammer | 229/930 |
| 2,558,918 | 7/1951 | Zinn, Jr. | 220/418 |
| 3,069,063 | 12/1962 | King, Jr. et al. | 220/416 |
| 4,685,610 | 8/1987 | Carter et al. | 229/23 R |
| 5,116,290 | 5/1992 | Ross | 229/109 |
| 5,294,044 | 3/1994 | Clark | 229/919 |
| 5,316,207 | 5/1994 | Ross et al. | 229/109 |
| 5,415,342 | 5/1995 | Harrelson | 229/169 |
| 5,415,344 | 5/1995 | Harrelson | 229/169 |

*Primary Examiner*—Gary E. Elkins

[57] ABSTRACT

A carton including a bevel panel and adjacent areas comprised of multi-ply construction. The bevel panel of each ply is defined in part by spaced score lines. The score lines of each ply are spaced apart a distance greater than the spacing of the score lines of the next outer ply. This results in the plies of the bevel panel being slightly spaced from each other. An example of such bevel panels is in the type of container formed by wrapping a slotted flexible sheet about rigid end panels having corner areas which extend through the slots.

20 Claims, 3 Drawing Sheets

CARTON WITH MULTI-PLY FOLDS

FIELD OF THE INVENTION

This invention relates to cartons which include panels of multi-ply construction. More particularly, the invention relates to a carton of this type which includes a pair of folds each of which forms an angle of less than 90°.

BACKGROUND OF THE INVENTION

One type of container used for packaging produce is comprised of rigid end panels about which a flexible cover sheet is wrapped in order to form the bottom, side and top panels. The end panels include stacking projections on their upper or lower edge and stacking recesses on their opposite edge so that when the containers are stacked, the projections from one container fit into the recesses of the next higher or lower container. The flexible sheet includes slots for receiving the stacking projections and slotted bevel panels associated with the corners of the end panels. Means are also provided on the end panels for holding the ends of the sheet in place.

Details of the design may vary depending on the requirements of the container. For example, the ends of the sheet may overlap to form a fully enclosed container or they may be spaced from each other to provide a partially open top panel. Also, the strength requirements of the side panels of the containers will vary, depending on the weight of the contents of the containers, the number of containers stacked on a pallet and the force applied when strapping or stretch wrapping the containers onto a pallet. For containers which require side wall, but not bottom panel, strengthening, it has been suggested that a two-ply side panel construction be employed. While such an arrangement provides adequate strength, it has been found that the bevel panels are difficult to fold. It is therefore an object of the invention to provide a multi-ply side panel in a carton or similar container which can readily be folded to form a bevel panel.

BRIEF SUMMARY OF THE INVENTION

The invention pertains to cartons which incorporate panels, such as bevel panels, the opposite edges of which are defined by spaced substantially parallel folds, each fold extending at an acute angle with respect to adjacent portions of the carton. The panels are formed from a flexible sheet of multi-ply construction. The folds of the panel are defined in each of the plies by score lines, with the score lines in the inner ply being spaced apart a distance greater than the score lines of the folds in the next ply. This offset relationship allows the panel to be readily folded from a blank and also results in the inner ply of the panel being spaced a short distance from the second ply of the panel, thereby strengthening the panel. Preferably, portions of the plies are adhered to each other in the adjacent portions of the sheet, with the adhered portions being spaced from the panel. The invention is applicable to a three-ply arrangement as well, as explained in more detail below.

These and other features and aspects of the invention, as well as its various benefits, are made more clear in the detailed description of the preferred embodiments which follows.

DETAILED DESCRIPTION OF THE PREFERRED EMBODIMENTS

Figure 1:
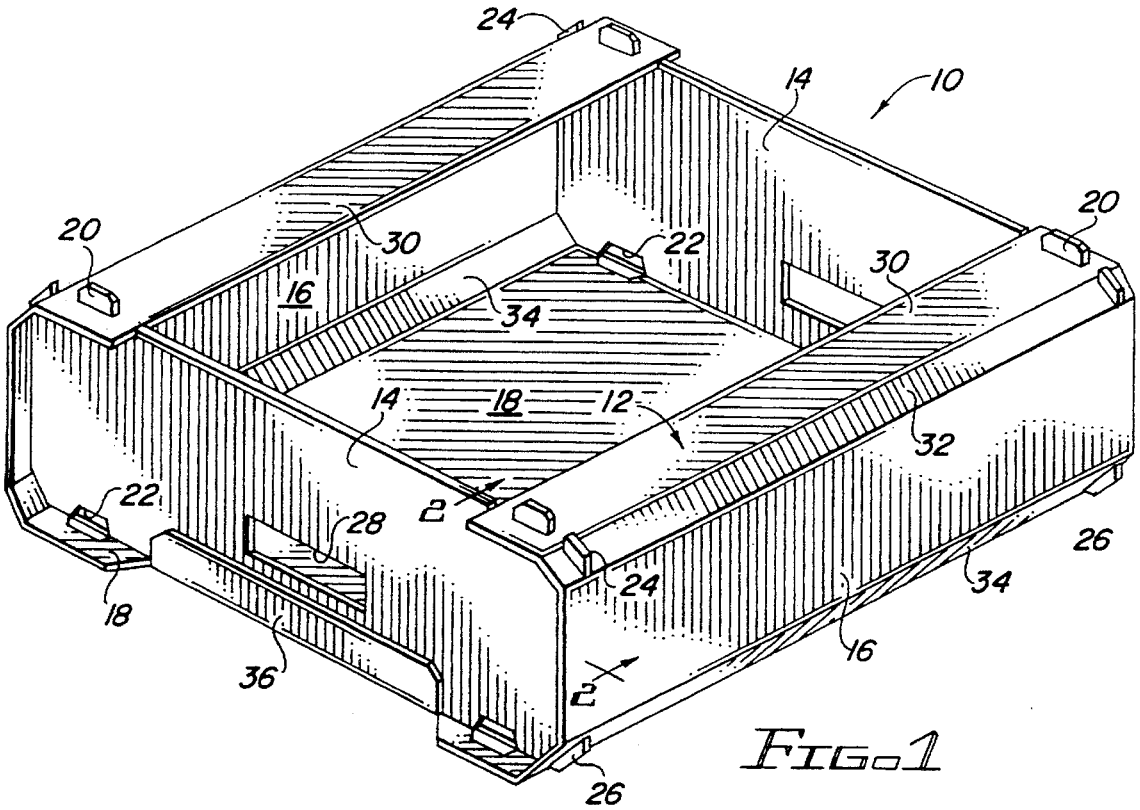
FIG. 1 is a pictorial view of a container incorporating the invention.

Referring to FIG. 1, a carton or container 10 embodying the concepts of the invention is comprised of a flexible cover sheet 12 and rigid end panels 14. The cover sheet, which forms the side panels 16 and the bottom panel 18, may be formed of paperboard or other suitable flexible material and is of a thickness normally used in the manufacture of carriers from foldable paperboard blanks, while the end panels are formed of thick paperboard, pressed board or any other readily available economical rigid material.

The end panels 14 are of generally rectangular shape, and include upwardly extending stacking projections 20 adjacent the upper corner areas. Stacking recesses 22 are formed adjacent the lower corner areas so as to be aligned with the projections 20. The upper corner areas of the end panel are indicated at 24 and the lower corner areas at 26. Openings 28 provide hand grips for lifting the container and also allow air to flow into the container to keep packaged produce in fresh condition. The stacking projections 20 extend up through slots in the short top panel sections 30 of the cover sheet to hold the ends of the cover sheet in place while the upper and lower corner areas 24 and 26 extend through slots in upper and lower bevel panels 32 and 34. Flaps 36 may be folded up from the bottom panel and adhered-to the end panels to provide a rigid construction.

Figure 2:
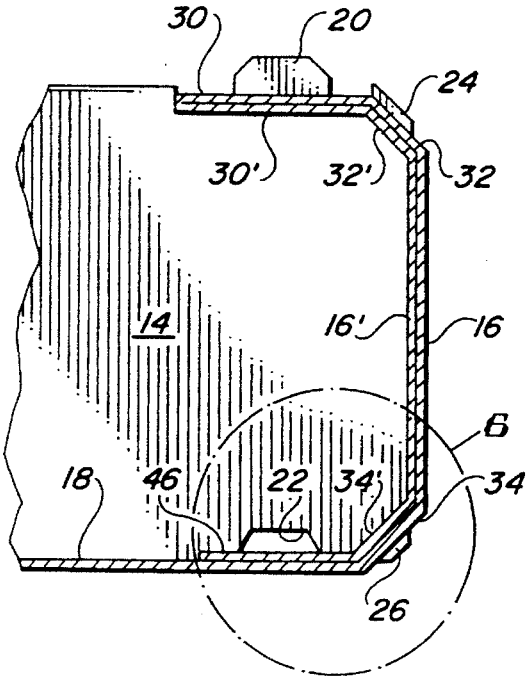
FIG. 2 is a transverse sectional view taken along line 2—2 of FIG. 1.

As illustrated in FIG. 2, the portions of the cover sheet forming the side panels 16, the top panel sections 30, the bevel panels 32 and 34 and a short portion of the bottom panel 18 are of two-ply construction for the purpose of strengthening these areas. These elements of the outer ply are identified by the reference numerals noted. The similar elements of the inner ply are identified by the same numerals but with the prime symbol appended.

Figure 3:
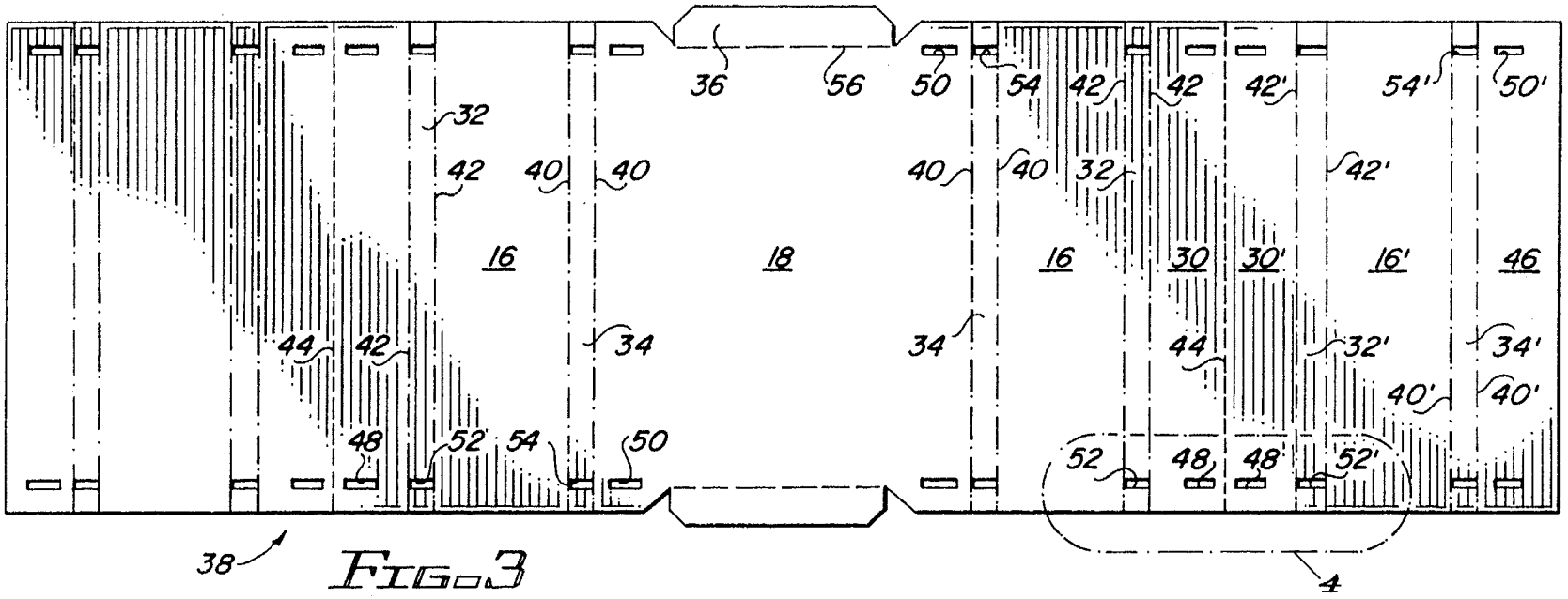
FIG. 3 is a plan view of the blank used in forming the cover sheet employed in the container of FIG. 1.

The blank 38 used to form the cover sheet of the container of FIG. 1 is shown in FIG. 3, wherein similar reference numerals to those used in FIGS. 1 and 2 denote similar elements. The substantially rectangular blank includes a series of parallel score lines which allow the sheet to be folded about the end panels. Thus, lower bevel panel sections 34 are connected by spaced parallel score lines 40 to the centrally located bottom panel section 18 and to the side panel sections 16. Similarly, upper bevel panel sections 32 are connected by spaced parallel score lines 42 to the side panel sections 16 and to the narrow top panel sections 30. The top panel sections 30 are connected by fold lines 44 to top panel reinforcing sections 30', and spaced parallel score lines 42' connect upper bevel panel reinforcing sections 32' to the top panel reinforcing sections 30' and to the side panel reinforcing sections 16'. Spaced parallel fold lines 40' connect lower bevel reinforcement panel sections 34' to the side panel reinforcement sections 16' and to short bottom panel reinforcement flaps 46.

The short top panel primary sections 30 and reinforcement sections 30' include slots 48 and 48' for receiving the projections 20 of the end panels, while the bottom panel section 18 and the bottom panel reinforcement flaps 46 include slots 50 and 50' for receiving the projections 20 of the next lower carton in a stack of carton containers. The upper bevel panel sections 32 and the upper bevel panel reinforcement sections 32' include slots 52 and 52' for receiving the upper corner areas 24 of the end panels, and the lower bevel panel sections 34 and lower bevel panel reinforcement sections 34' include slots 54 and 54' for receiving the lower corner areas 26 of the end panels. The end glue flaps 36 are connected to the bottom panel section by fold lines 56.

To fabricate the container of FIG. 1, the reinforcement sections of the blank are folded in about the fold lines 44 and adhered to the primary carton sections. Then the blank or cover sheet and the end panels are assembled by adhering the glue flaps 36 to the end panels, forming the bevel panels and inserting the corner areas 24 and 26 and the projections 20 through the appropriate slots. As indicated above, folding of two-ply bevel panels is normally difficult because of the added thickness of the reinforcement sections. It was initially thought that this difficulty could be alleviated by forming the bevel panel score lines so that each pair of score lines of the inner reinforcement ply were more closely spaced apart than the corresponding pair of score lines in the primary carton panels. Such an arrangement seemed logical in order to compensate for the folding action of the relatively thick combined plies. This, however, made it even more difficult to fold. Surprisingly, it was found that an opposite score line arrangement greatly facilitates the folding of the bevel panels.

Figure 4:
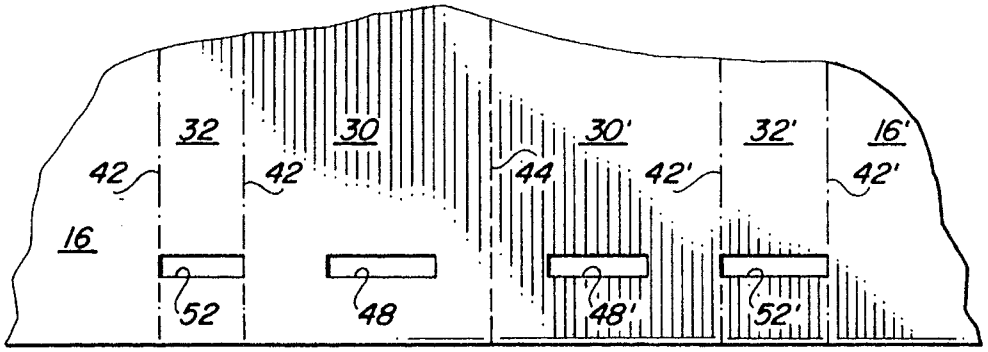
FIG. 4 is an enlarged plan view of the area of the blank of FIG. 3 within the oval 4.

Referring to FIG. 4, the larger scale of the drawing shows that the score lines 42' of the upper reinforcement bevel panel sections 32' are spaced farther apart than the score lines 42 of the upper bevel panel sections 32. Although not illustrated, a similar arrangement exists for the score lines of the lower bevel panel sections, with the score lines 40' of the lower bevel reinforcement panel sections 34' being spaced farther apart than the score lines 40 of the lower bevel panel sections 34. When folded into final blank position, the reinforcement panels are adhered to the inner surface of the main carton panels, so that the score lines defining the reinforcement bevel panels are outwardly offset from the score lines defining the main bevel panels.

Figure 5:
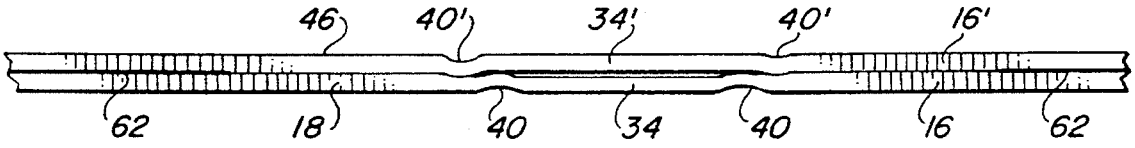
FIG. 5 is an enlarged partial end view of the folded blank.

This arrangement is illustrated with respect to the still more enlarged lower bevel panel sections of FIG. 5, which shows the score lines 40' of the lower reinforcement bevel section 34' being more widely spaced apart than the score lines 40 of the lower bevel section 34. Also note that the layer of adhesive 62 bonding the top and side panels to their reinforcement sections stops short of the bevel panel, and that the bevel panel sections are not adhered to each other.

Figure 6:
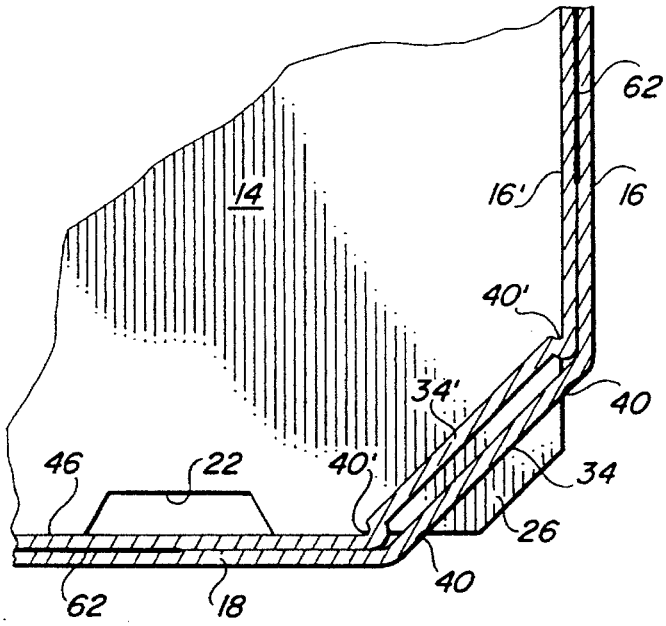
FIG. 6 is an enlarged transverse sectional view of the portion of FIG. 2 within the circle 6.

When the bevel panel is folded into place the folding action preferentially follows the score lines 40'. There is no tendency for the folding action to take place about the score lines 40 since the adjacent underlying bevel panel section 34 acts as a barrier. As the folding action progresses, the convex surfaces of the score lines 40' act as levers, pushing the inner surface of the primary ply out away from the bevel reinforcement panel. This results in the final folded configuration shown in FIG. 6, wherein the bevel panel 34 has been pushed apart from the bevel reinforcement panel 34'. The folding process is not only made simpler by the fact that folding takes place primarily about the score lines of only one of the plies instead of two, but the resulting structure provides additional reinforcement, acting as a hollow beam, wherein opposite major surfaces of the beam are formed by the bevel panels 34 and 34' and opposite minor surfaces are the formed by the ridges in the reinforcement panel formed by the scores 40'.

The spacing of the bevel reinforcement panel score lines relative to the primary bevel panel score lines will vary depending upon the thickness of the blank sheet material and the size of the bevel panels. This is best determined by experimentation for each proposed carton design. By way of example, however, in one design which demonstrated the improved folding performance of the invention the inner bevel panel was ⅝ inch wide and the outer bevel panel was ½ inch wide, with the wider score lines being offset from the narrower score lines by 1/16 inch.

As indicated, the glue line for adhering the top panel sections together and the side panel sections together should stop short of the bevel panel score lines. The preferred spacing for this is also best determined by experimentation. Enough of the top panel sections and side panel sections, however, must remain unglued in order to be capable of the adjusting movements that occur during folding when the associated bevel panels and adjacent portions of the top and side panel sections move slightly with respect to each other. By way of example, in the same carton design in which the pairs of score lines were spaced apart ⅝ inch and ½ inch, the glue line terminated about one inch from the bevel panel score lines.

Figure 7:
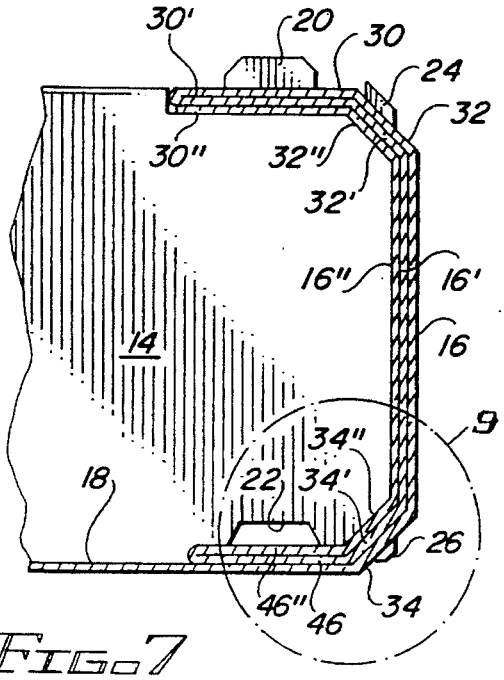
FIG. 7 is a transverse sectional view similar to that of FIG. 2, but showing a modified container incorporating a side panel formed of three plies of material.

The invention is not limited to the formation of folds in panels of two-ply construction. As shown in the embodiment of FIG. 7, the end panel structure is comprised of three plies, the second ply being folded under at the end of the top panel section and the third ply being folded up from the second ply from a point inwardly spaced from the projection slots. The third ply sections are indicated in this and subsequent figures by the double prime symbol.

Figure 8:
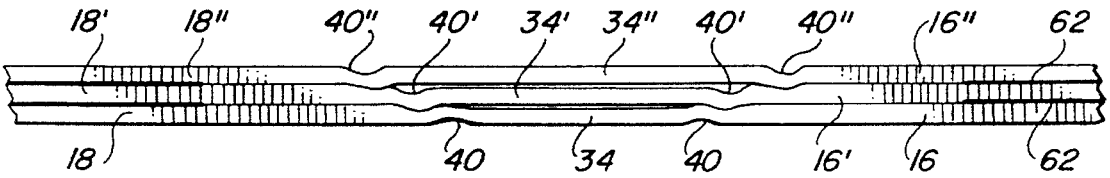
FIG. 8 is an enlarged partial end view of a three-ply folded blank.

Referring to FIG. 8, the bevel panel score lines of each of the inner plies are more widely spaced apart than in the next outer ply. Thus the score lines 40" are more widely spaced apart than the score lines 40', which in turn are more widely spaced apart than the score lines 40. The glue area in this construction is similar to that of the two-ply arrangement in that it stops short of the bevel panel score lines.

Figure 9:
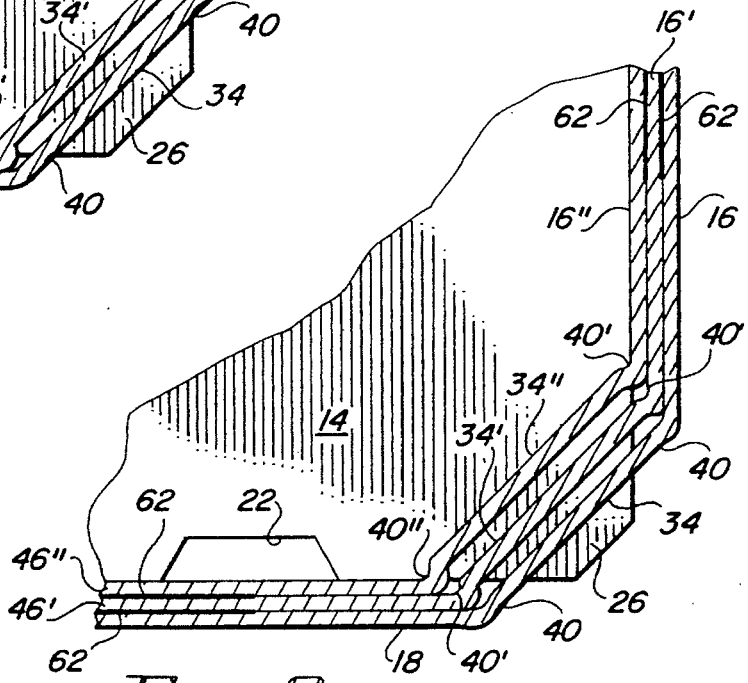
FIG. 9 is an enlarged transverse sectional view of the portion of FIG. 7 within the circle 9.

When the bevel panels are formed, the folding action preferentially follows the score lines 40" first, followed by the score lines 40'. The convex surfaces of the score lines 40" and 40' act as levers, pushing adjacent plies away from the associated bevel panel. This results in the final folded configuration shown in FIG. 9, wherein the bevel panel 34 has been pushed apart from the bevel reinforcement panel 34' and the latter panel has been pushed apart from the bevel reinforcement panel 34". As in the two-ply design, the resulting structure provides additional reinforcement in the form of hollow beams, formed by the spaced bevel panels 34, 34' and 34" and the spaced ridges formed by the scores 40' and 40".

In the illustrated cartons the top panel forms an angle of 90° with the side panel, but a lesser angle with the bevel panel. Similarly, the bevel panel forms a lesser angle with the adjacent side panel. It should be understood that although the invention is not limited to the formation of a carton bevel panel, the phenomenon described is concerned primarily with the folding of multi-ply panels through an angle of less than 90° about two spaced parallel fold lines.

It can now be appreciated that the invention provides a container which enables it to be customized as to the number of plies making up the side panels while at the same time facilitating the folding of carton blanks of multi-ply construction. The carton is further strengthened by the unique hollow beam or honeycomb arrangement of the bevel panel plies.

It should be obvious that although preferred embodiments of the invention have been described, changes to certain details of the embodiments can be made without departing from the spirit and scope of the invention defined in the appended claims.

What is claimed is:

1. In a carton comprised at least in part of a flexible sheet incorporating a panel having opposite edges defined by spaced substantially parallel folds, each fold extending at an acute angle with respect to adjacent portions of the sheet, the improvement comprising:

the panel and adjacent portions of the sheet being of multi-ply construction, including an inner ply and a second ply adjacent thereto;

the folds of the panel being defined in each of the plies by score lines;

the score lines of the folds in the inner ply being spaced apart a distance greater than the score lines of the folds in the second ply.

2. The carton improvement of claim 1, wherein the inner ply of the panel is spaced a relatively small distance from the second ply of the panel.

3. The carton improvement of claim 2, wherein the inner ply includes portions extending transversely of the panel from the folds of the inner ply to the second ply.

4. The carton improvement of claim 1, wherein the inner and second plies of the adjacent portions of the sheet are in substantially face-to-face contact.

5. The carton improvement of claim 4, wherein portions of the inner and second plies are adhered to each other in the adjacent portions of the sheet, the adhered portions being spaced from the panel a relatively great distance compared to the spacing of the inner and second plies of the panel.

6. The carton improvement of claim 1, including an outer ply adjacent the second ply, the folds of the panel in the outer ply being defined by score lines spaced apart a lesser distance than the panel score lines of the second ply.

7. The carton improvement of claim 6, wherein the inner ply of the panel is spaced a relatively small distance from the second ply of the panel and the second ply of the panel is spaced a relatively small distance from the outer ply of the panel.

8. A container, comprising:

two spaced, substantially parallel, relatively rigid end panels;

a flexible sheet attached to and extending between the end panels to form panels of the container;

the container including at least one bevel panel having opposite edges defined by spaced substantially parallel folds, each fold extending at an acute angle with respect to adjacent portions of the flexible sheet;

the bevel panel and the adjacent portions of the sheet being of multi-ply construction, including an inner ply and a second ply adjacent thereto;

the folds of the bevel panel being defined in each of the plies by score lines;

the score lines of the bevel panel folds in the inner ply being spaced apart a distance greater than the score lines of the bevel panel folds in the second ply.

9. The container of claim 8, wherein the inner ply of the bevel panel is spaced a relatively small distance from the second ply of the bevel panel.

10. The container of claim 9, wherein the inner ply of the bevel panel includes portions extending transversely thereof from the bevel panel folds to the second ply.

11. The container of claim 9, wherein the inner and second plies of the adjacent portions of the sheet are in substantially face-to-face contact, portions of the inner and second plies being adhered to each other in the adjacent portions of the sheet, the adhered portions being spaced from the bevel panel a relatively great distance compared to the spacing of the inner and second plies of the bevel panel.

12. The container of claim 8, including an outer ply adjacent the second ply, the folds of the bevel panel in the outer ply being defined by score lines spaced apart a lesser distance than the bevel panel score lines of the second ply.

13. The container of claim 12, wherein the inner ply of the bevel panel is spaced a relatively small distance from the second ply of the bevel panel and the second ply of the bevel panel is spaced a relatively small distance from the outer ply of the bevel panel.

14. The container of claim 8, wherein the end panels include upper and lower corner areas and the flexible sheet includes a bevel panel associated with each corner area, the upper corner areas of the end panels extending through slots in the bevel panels associated therewith and the lower corner areas of the end panels extending through slots in the bevel panels associated therewith.

15. The container of claim 14, wherein the end panels include upwardly extending projections, the projections extending through slots in the flexible sheet.

16. A carton blank, comprising:

a flexible sheet at least a portion of which is of multi-ply construction;

the sheet incorporating a bevel panel section in the multi-ply portion thereof defined by spaced substantially parallel score lines;

one of the plies of the bevel panel section forming the inner ply in a carton formed from the blank and the ply next adjacent thereto forming a second ply of such a carton;

the score lines of said one ply of the bevel panel section being spaced apart a distance greater than the score lines of the next adjacent ply.

17. The carton blank of claim 16, wherein portions of the said one ply and the next adjacent ply are adhered to each other in portions of the sheet on either side of the bevel panel section, the adhered portions being spaced from the bevel panel section a substantial amount.

18. The carton blank of claim 16, wherein the ply of the bevel panel section next adjacent said one ply is the second ply and the bevel panel section includes a third ply next adjacent the second ply, the score lines of the second ply of the bevel panel section being spaced apart a greater distance than the bevel panel section score lines of the third ply of the bevel panel section.

19. A method of forming a bevel panel in a carton comprised at least in part of a flexible sheet of multi-ply construction, comprising:

forming a first pair of spaced score lines in the sheet to define a bevel panel section in an inner ply of the carton;

forming a second pair of spaced score lines in the sheet to define a bevel panel section in the next adjacent ply of the carton;

the first pair of score lines being spaced apart a greater distance than the second pair of score lines; folding the sheet about a fold line located between the first and second pairs of score lines so that the score lines of the second pair are inwardly offset from the score lines of the first pair;

adhering the folded portions of the sheet together without adhering the bevel panel sections to each other; and forming the bevel panel by inwardly folding the multi-ply sheet about the first pair of spaced score lines.

20. The method of forming a bevel panel in a carton as defined in claim 19, wherein folding the multi-ply sheet about the first pair of fold lines causes the inner ply of the bevel panel to be spaced a relatively small distance from the next adjacent ply of the bevel panel.

* * * * *